US009745639B2

(12) United States Patent
Mizuta et al.

(10) Patent No.: US 9,745,639 B2
(45) Date of Patent: Aug. 29, 2017

(54) HIGH-STRENGTH STEEL SHEET EXCELLENT IN WORKABILITY AND COLD BRITTLENESS RESISTANCE, AND MANUFACTURING METHOD THEREOF

(75) Inventors: Sae Mizuta, Kakogawa (JP); Yuichi Futamura, Kakogawa (JP); Yukihiro Utsumi, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 569 days.

(21) Appl. No.: 13/489,005

(22) Filed: Jun. 5, 2012

(65) Prior Publication Data

US 2012/0312433 A1 Dec. 13, 2012

(30) Foreign Application Priority Data

Jun. 13, 2011 (JP) ..... 2011-130835

(51) Int. Cl.
*C22C 38/04* (2006.01)
*C22C 38/02* (2006.01)
(Continued)

(52) U.S. Cl.
CPC ..... *C21D 1/20* (2013.01); *C21D 8/0447* (2013.01); *C21D 8/0463* (2013.01); *C21D 8/0473* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01);
(Continued)

(58) Field of Classification Search
CPC ... C22C 38/001; C22C 38/002; C22C 38/005; C22C 38/02; C22C 38/06; C22C 38/08; C22C 38/01; C22C 38/14; C22C 38/16; C22C 38/18; C22D 2211/008; C21D 2211/002; C21D 2211/005
USPC ..... 148/645, 337; 420/8
See application file for complete search history.

(56) References Cited

U.S. PATENT DOCUMENTS

2005/0247378 A1 11/2005 Ikeda et al.
2006/0137768 A1 6/2006 Yuse et al.
(Continued)

FOREIGN PATENT DOCUMENTS

CN 101821419 A 9/2010
EP 2 267 176 A1 12/2010
(Continued)

OTHER PUBLICATIONS

Machine translation of JP 2002060898, 2002.*
(Continued)

*Primary Examiner* — Rebecca Lee
(74) *Attorney, Agent, or Firm* — Oblon, McClelland, Maier & Neustadt, L.L.P.

(57) ABSTRACT

The invention relates to a steel sheet having a tensile strength of 1180 MPa or more, which excels in workability and cold brittleness resistance. The high-strength steel sheet contains 0.10% to 0.30% of C, 1.40% to 3.0% of Si, 0.5% to 3.0% of Mn, 0.1% or less of P, 0.05% or less of S, 0.005% to 0.20% of Al, 0.01% or less of N, 0.01% or less of O, as well as Fe and inevitable impurities. The steel sheet has: (i) a ferrite volume fraction of 5% to 35% and a bainitic ferrite and/or tempered martensite volume fraction of 60% or more; (ii) a MA constituent volume fraction of 6% or less (excluding 0%); and (iii) a retained austenite volume fraction of 5% or more.

20 Claims, 3 Drawing Sheets

(51) Int. Cl.

| | |
|---|---|
| ***C21D 1/20*** | (2006.01) |
| ***C21D 9/46*** | (2006.01) |
| ***C22C 38/00*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C21D 8/04*** | (2006.01) |

(52) U.S. Cl.

CPC ..... *C22C 38/08* (2013.01); *C22C 38/12* (2013.01); *C22C 38/14* (2013.01); *C22C 38/16* (2013.01); *C22C 38/18* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2006/0169366 | A1 | 8/2006 | Yuse et al. | |
| 2008/0000555 | A1* | 1/2008 | Nonaka et al. | 148/328 |
| 2008/0023112 | A1 | 1/2008 | Kashima | |
| 2008/0178972 | A1 | 7/2008 | Saito et al. | |
| 2008/0251160 | A1 | 10/2008 | Akamizu et al. | |
| 2009/0053096 | A1 | 2/2009 | Miura et al. | |
| 2009/0314395 | A1 | 12/2009 | Nonaka et al. | |
| 2010/0218857 | A1 | 9/2010 | Nakagaito et al. | |
| 2010/0221138 | A1 | 9/2010 | Nakaya et al. | |
| 2010/0247957 | A1 | 9/2010 | Hoshika et al. | |
| 2011/0146852 | A1 | 6/2011 | Matsuda et al. | |
| 2011/0287280 | A1 | 11/2011 | Shiraki et al. | |

FOREIGN PATENT DOCUMENTS

| | | | | | |
|---|---|---|---|---|---|
| EP | 2 325 346 | A1 | | 5/2011 | |
| EP | 2 327 810 | A1 | | 6/2011 | |
| EP | 2 436 794 | A1 | | 4/2012 | |
| JP | 2002060898 | A | * | 2/2002 | C22C 38/00 |
| JP | 2003-193193 | A | | 7/2003 | |
| JP | 2004-332099 | A | | 11/2004 | |
| JP | 2006-104532 | A | | 4/2006 | |
| JP | 3889768 | | | 12/2006 | |
| JP | 2008-101238 | | | 5/2008 | |
| JP | 2010-65272 | A | | 3/2010 | |
| JP | 2010-90475 | | | 4/2010 | |
| JP | 2010-196115 | | | 9/2010 | |
| WO | 2010/137343 | | | 12/2010 | |

OTHER PUBLICATIONS

Combined United Kingdom Search and Examination Report Issued Oct. 1, 2012 in Patent Application No. GB1210376.8.

Examination Report under Section 18(3) as received in the corresponding Great Britain Application No. 1210376.8 dated Sep. 13, 2013.

* cited by examiner

HIGH-STRENGTH STEEL SHEET EXCELLENT IN WORKABILITY AND COLD BRITTLENESS RESISTANCE, AND MANUFACTURING METHOD THEREOF

CROSS REFERENCE TO RELATED APPLICATIONS

The present application claims the benefit of Japanese patent application no. JP2011-130835, filed on Jun. 13, 2011, the text of which is incorporated by reference.

FIELD OF INVENTION

The present invention relates to high-strength steel sheets excellent in workability and resistance to cold brittleness. Specifically, the present invention relates to high-strength steel sheets each having a tensile strength of 1180 MPa or more and exhibiting satisfactory workability and good resistance to cold brittleness; and to manufacturing methods of the high-strength steel sheets.

BACKGROUND OF THE INVENTION

For increasing fuel efficiency typically in automobiles and transports (transport equipment), weight reduction of automobiles and transports are demanded. Typically, it is effective for weight reduction to employ high-strength steel sheets so as to allow parts constituting the automobiles and transports to have smaller thicknesses. In addition, automobiles particularly require collision safety, and structural parts such as pillars, and reinforcing parts such as bumpers and impact beams should therefore have further higher strengths. However, steel sheets, if having a higher strength, have poor ductility (hereinafter also referred to as "elongation capacity" or "elongation") and thereby have inferior workability. Such high-strength steel sheets should have both a high strength and good workability (good balance between tensile strength (TS) and elongation (EL)).

As a technique for obtaining a high-strength steel sheet having both a high strength and good workability, for example, U.S. Patent Application Publication No. 2008/0178972 proposes a high-strength steel sheet which has a structure including martensite and retained austenite as second phases being dispersed in specific proportions in ferrite matrix and which excels in elongation and stretch flangeability.

U.S. Patent Application Publication No. 2009/0053096 proposes a high-strength cold-rolled steel sheet which has controlled contents of silica (Si) and manganese (Mn), has a structure including tempered martensite and ferrite as principal components and further including retained austenite, and excels in coating adhesion and elongation.

Japanese Unexamined Patent Application Publication (JP-A) No. 2010-196115 proposes a high-strength cold-rolled steel sheet which has a structure including ferrite, tempered martensite, martensite, and retained austenite and excels in workability and impact resistance.

Japanese Unexamined Patent Application Publication (JP-A) No. 2010-90475 proposes a high-strength steel sheet which has a structure including bainitic ferrite, martensite, and retained austenite, excels in elongation and stretch flangeability, and has a tensile strength of 980 MPa or more.

Recent steel sheets typically for automobiles particularly require improvements not only in the proposed properties such as strength and workability but also in safety in assumed use environments. For example, the steel sheets are demanded to have also satisfactory resistance to cold brittleness, on the assumption of body collision under low-temperature conditions during wintertime. However, the customary steel sheets, which are intended to improve strength and workability, fail to ensure sufficient resistance to cold brittleness, because they tend to have inferior resistance to cold brittleness when having higher strengths. Thus, further improvements have been demanded.

SUMMARY OF THE INVENTION

The present invention has been made under these circumstances, and an object thereof is to provide a high-strength steel sheet having a tensile strength of 1180 MPa or more and having satisfactory workability and good resistance to cold brittleness. Another object of the present invention is to provide a method for producing the high-strength steel sheet.

The present invention achieves the objects and provides, in an aspect, a steel sheet containing carbon (C) in a content of from 0.10% to 0.30% (percent by mass; hereinafter the same is applied to contents of chemical compositions), silicon (Si) in a content of from 1.40% to 3.0%, manganese (Mn) in a content of from 0.5% to 3.0%, phosphorus (P) in a content of 0.1% or less, sulfur (S) in a content of 0.05% or less, aluminum (Al) in a content of from 0.005% to 0.20%, nitrogen (N) in a content of 0.01% or less, and oxygen (O) in a content of 0.01% or less, with the remainder including iron (Fe) and inevitable impurities. The steel sheet has a volume fraction of ferrite of from 5% to 35% and a volume fraction of bainitic ferrite and/or tempered martensite of 60% or more based on the total volume of structures as determined through observation of the structures at a position of a depth one-quarter the thickness of the steel sheet under a scanning electron microscope. The steel sheet has a volume fraction of a mixed structure (MA constituent) of fresh martensite and retained austenite of 6% or less (excluding 0%) based on the total volume of structures as determined through observation of the structures under an optical microscope. The steel sheet has a volume fraction of retained austenite of 5% or more based on the total volume of structures as determined through X-ray diffractometry of retained austenite. The steel sheet has a tensile strength of 1180 MPa or more.

In a preferred embodiment, the steel sheet further contains, as an additional element, at least one element selected from the group consisting of chromium (Cr) in a content of from 1.0% or less and molybdenum (Mo) in a content of from 1.0% or less.

In still another preferred embodiment, the steel sheet further contains, as an additional element, at least one element selected from the group consisting of titanium (Ti) in a content of 0.15% or less, niobium (Nb) in a content of 0.15% or less, and vanadium (V) in a content of 0.15% or less.

In yet another preferred embodiment, the steel sheet further contains, as an additional element, at least one element selected from the group consisting of copper (Cu) in a content of from 1.0% or less and nickel (Ni) in a content of from 1.0% or less.

In another preferred embodiment, the steel sheet further contains, as an additional element, boron (B) in a content of from 0.005% or less.

The steel sheet, in still another embodiment, further contains, as an additional element, at least one element selected from the group consisting of calcium (Ca) in a content of 0.01% or less, magnesium (Mg) in a content of 0.01% or less, and one or more rare-earth elements (REM) in a content of 0.01% or less.

The present invention further provides, in another aspect, a method for manufacturing a steel sheet. This method includes the steps of preparing a steel sheet through rolling from a steel having the above-specified chemical composition; soaking the rolled steel sheet at a temperature higher than $Ac_1$, point by 20° C. or more and lower than the $Ac_3$ point; cooling the soaked steel sheet at an average cooling rate of 5° C./second or more to a temperature in the range of from 100° C. to 400° C.; and holding the cooled steel sheet in a temperature range of from 200° C. to 500° C. for 100 seconds or longer.

In addition and advantageously, the present invention provides a method for manufacturing a steel sheet. This method includes the steps of preparing a steel sheet through rolling from a steel having the above-specified chemical composition; soaking the rolled steel sheet at a temperature equal to or higher than $Ac_3$ point; cooling the soaked steel sheet at an average cooling rate of 50° C./second or less to a temperature in the range of from 100° C. to 400° C.; and holding the cooled steel sheet in a temperature range of from 200° C. to 500° C. for 100 seconds or longer.

The present invention provides a high-strength steel sheet which excels in workability and resistance to cold brittleness even when having a high tensile strength of 1180 MPa or more. In particular, the high-strength steel sheet according to the present invention has satisfactory balance between strength and elongation (TS-FT, balance). Additionally, the present invention can manufacture a high-strength steel sheet according to an industrially practical process, which steel sheet has excellent workability and good resistance to cold brittleness.

The high-strength steel sheet according to the present invention is extremely useful particularly typically in industrial areas such as automobiles.

DESCRIPTION OF THE PREFERRED EMBODIMENTS

Figure 1:
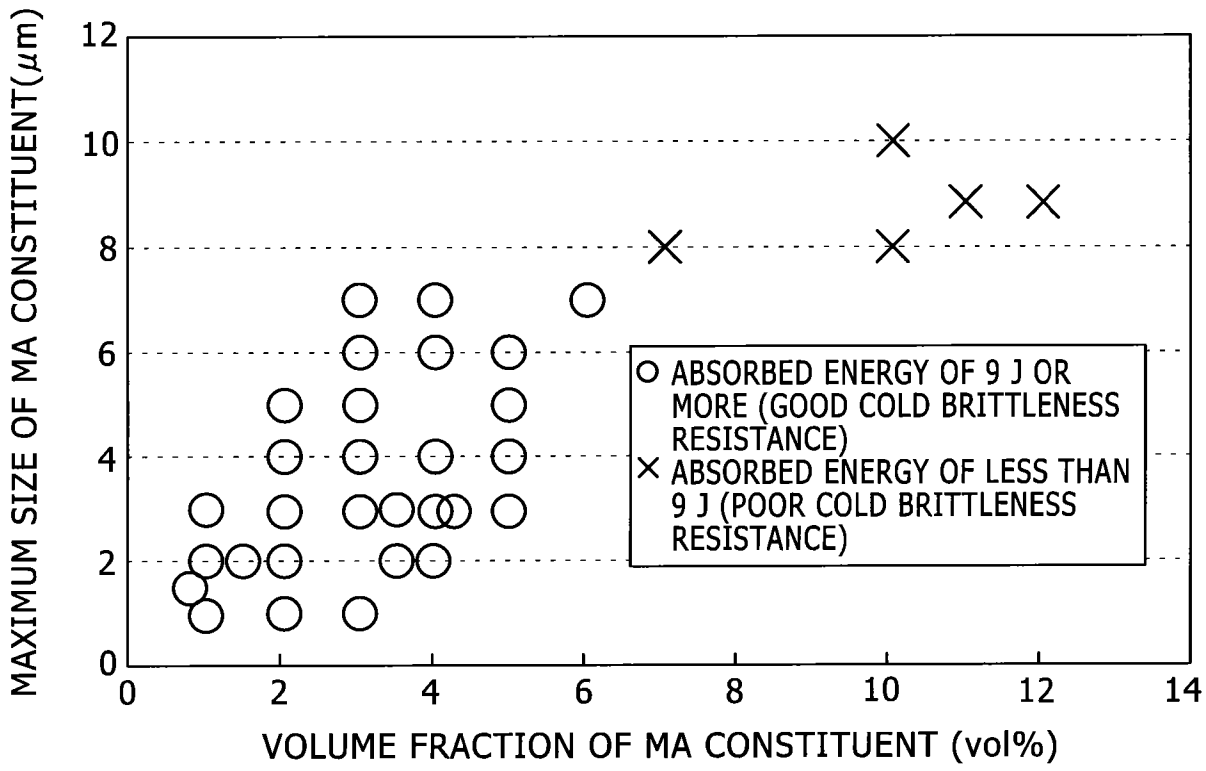
FIG. 1 is a graph illustrating how the resistance to cold brittleness varies depending on the maximum size and volume fraction of MA constituent.

The present inventors made intensive investigations to improve the workability and resistance to cold brittleness of high-strength steel sheets having tensile strengths of 1180 MPa or more. As a result, the present inventors found that there can be provided a high-strength steel sheet in the following manner, which steel sheet has both satisfactory workability and good resistance to cold brittleness while maintaining a high strength of 1180 MPa or more. Specifically, on the assumption that the chemical composition is controlled appropriately, a steel sheet can have improved resistance to cold brittleness while ensuring strength and workability at satisfactory levels, by allowing the steel sheet to have an appropriately controlled metal structure including ferrite, retained austenite (hereinafter also referred to as "retained γ"), MA constituent, and at least one of bainitic ferrite and tempered martensite (hereinafter also referred to as "bainitic ferrite and/or tempered martensite") in specific proportions. The present invention has been made based on these findings. In particular, the present invention has been made based on the finding that a mixed structure including fresh martensite and retained austenite (MA constituent: martensite-austenite constituent) plays an important role in improvements of strength and resistance to cold brittleness of the steel sheet.

As used herein the term "high-strength steel sheet" refers to a steel sheet having a tensile strength (TS) of 1180 MPa or more, preferably 1200 MPa or more, and more preferably 1220 MPa or more. The steel sheet desirably has an elongation (elongation capacity or ductility; EL) of preferably 13% or more, and more preferably 14% or more. The steel sheet has a balance between tensile strength and elongation (TS-EL balance) of preferably 17000 or more, more preferably 18000 or more, and furthermore preferably 20000 or more. The TS-ET balance serves as an index of workability. In terms of resistance to cold brittleness, the steel sheet has an absorbed energy of preferably 9 joules (J) or more, and more preferably 10 J or more in a Charpy impact test at −40° C. (Japanese Industrial Standards (JIS) Z2224, 1.4 mm in thickness).

The terms "elongation (EL)" and "TS-EL balance" are also herein collectively referred to as "workability."

As used herein the term "MA constituent" refers to a mixed structure of fresh martensite and retained γ, in which it is difficult to separate (distinguish) fresh martensite and retained γ from each other by observation under a microscope. The term "fresh martensite" refers to a structure which is formed from untransformed austenite through martensitic transformation during a process of cooling the steel sheet from a heating temperature to room temperature and is distinguished from tempered martensite after a heating treatment (austempering).

The structure constituting the steel sheet according to the present invention may include bainitic ferrite and/or tempered martensite (as a matrix), ferrite, MA constituent, and retained austenite, with the remainder including inevitably formable microstructures. The retained austenite is present between laths of bainitic ferrite and in the MA constituent and cannot be identified by observation under a scanning electron microscope (SEM) or an optical microscope. The volume fractions of these constituents are measured by different techniques. Specifically, the volume fraction of the bainitic ferrite and/or tempered martensite (matrix) and the volume fraction of ferrite are values measured at a position of a depth one-quarter the thickness of the steel sheet through observation under a SEM; the volume fraction of MA constituent is a value measured through observation of a LePera etched specimen under an optical microscope; and the volume fraction of retained austenite is a value measured through X-ray diffractometry. A composite structure including fresh martensite and retained γ is measured as a MA constituent, because it is difficult to distinguish fresh martensite and retained γ constituting the MA constituent from each other by observation under an optical microscope. Accordingly, the total sum of contents of metal structures as specified according to the present invention may be more than 100%. This is because retained austenite constituting the MA constituent may be doubly measured not only by observation under an optical microscope but also by X-ray diffractometry.

The ranges of volume fractions of metal structures (microstructures) featuring the present invention, and reasons for specifying the ranges will be described in detail below. As used herein the term "volume fraction" as measured through observation under a microscope refers to the percentage of a microstructure occupying the entire structure (100%) of the steel sheet.

Volume Fraction of Ferrite: 5% to 35%

Ferrite is a structure which helps the steel sheet to have a higher elongation (EL). According to the present invention, by increasing the volume fraction of ferrite of the steel sheet, the steel sheet is allowed to have improved elongation even having a high strength in terms of tensile strength of 1180 MPa or more and to have better TS-EL balance. To exhibit these advantageous effects, the steel sheet has a volume fraction of ferrite of 5% or more, preferably 7% or more, and more preferably 10% or more. Excess ferrite, however, may cause the steel sheet to have an insufficient strength and to fail to have a high strength of 1180 MPa or more. To avoid these, the steel sheet has a volume fraction of ferrite of 35% or less, preferably 30% or less, and more preferably 25% or less.

Volume Fraction of Mixed Structure of Fresh Martensite and Retained Austenite (MA Constituent): 6% or Less (Excluding 0%)

The present inventors made investigations on how the MA constituent affects the workability and resistance to cold brittleness of the steel sheet and found that, although the MA constituent helps the steel sheet to have improved strength and elongation, the MA constituent, if present in excess, may adversely affect the resistance to cold brittleness. They also found that it is effective to control the MA constituent within a predetermined range for improving the workability without impairing the resistance to cold brittleness. The steel sheet according to the present invention should therefore contain the MA constituent as an essential constituent and should have a volume fraction of MA constituent of not 0% (more than 0%), preferably 1% or more, and more preferably 2% or more, and furthermore preferably 3% or more for effectively improving the strength and TS-EL balance. However, the steel sheet should have a volume fraction of MA constituent of 6% or less, preferably 5% or less, and more preferably 4% or less, because the MA constituent, if present in an excessively high volume fraction, may cause the steel sheet to have poor resistance to cold brittleness.

In a preferred embodiment of the present invention, the steel sheet has a controlled maximum size of MA constituent of 7 μm or less. This is because as follows. The present inventors performed experiments about how the volume fraction (percent by volume) and the maximum size (μm) of the MA constituent affect the resistance to cold brittleness; and experimentally found that it is desirable to control the maximum size of the MA constituent for ensuring desired resistance to cold brittleness, as indicated in FIG. 1. Specifically, with an increasing maximum size thereof, the MA constituent tends to cause cracking and to adversely affect the resistance to cold brittleness and, to avoid this, it is recommended to control the steel sheet to have a maximum size of MA constituent of preferably 7 μm or less, and more preferably 6 μm or less. The maximum size of MA constituent may be measured based on an optical micrograph of a LePera-etched specimen.

Volume Fraction of Bainitic Ferrite and/or Tempered Martensite (Matrix): 60% or More The remainder structure other than ferrite, MA constituent, and retained austenite as observed under an optical microscope or SEM is substantially bainitic ferrite and/or tempered martensite. As used herein the term "substantially" means to accept contamination of other structures (e.g., pearlite) inevitably formed during the manufacturing process of the steel sheet and indicates that the remainder basically includes bainitic ferrite and/or tempered martensite (bainitic ferrite and/or tempered martensite). The bainitic ferrite and/or tempered martensite serves as a principal structure in the steel sheet according to the present invention. The term "principal structure" refers to a structure having a largest volume fraction. The volume fraction of bainitic ferrite and/or tempered martensite is preferably 60% or more, and more preferably 65% or more; and is preferably 90% or less, and more preferably 80% or less for ensuring satisfactory elongation. The steel sheet preferably has a controlled volume fraction of other structures of about 5% or less (inclusive of 0%), which other structures constitute the remainder other than bainitic ferrite and tempered martensite and are inevitably formed.

The bainitic ferrite and tempered martensite are herein collectively specified, because the bainitic ferrite and tempered martensite cannot be distinguished from each other by observation under a SEM and are both observed as fine lath-shape structures.

Volume Fraction of Retained Austenite: 5% or More

The retained austenite structure is effective for improving elongation. In addition, the retained austenite structure is necessary for helping the steel sheet to have satisfactory TS-EL balance, because the retained austenite deforms and transforms into martensite by the action of strain applied upon working of the steel sheet, thereby ensures satisfactory elongation, and accelerates the hardening of a deformed portion during working to suppress strain concentration. To exhibit these advantageous effects effectively, the steel sheet has a volume fraction of retained γ of 5% or more, and more preferably 6% or more, and furthermore preferably 7% or more.

The retained γ is present in various forms and, for example, is present between laths of bainitic ferrite, present at grain boundary, and contained in the MA constituent, but the effects of the retained γ do not vary depending on the existence form thereof. A retained γ present within a measurement range is measured as retained γ herein, regardless of the existence form thereof. The volume fraction of retained austenite may be measured and determined by calculation through X-ray diffractometry.

Next, the chemical composition of the high-strength steel sheet according to the present invention will be described. The chemical composition of the high-strength steel sheet does not require expensive alloy elements such as nickel (Ni) as essential elements but includes alloy elements generally contained in industrial steel sheets such as steel sheets for automobiles. The chemical composition should be appropriately regulated so as to allow the steel sheet to have the above-specified metal structure while ensuring a tensile strength of 1180 MPa or more and avoiding adverse effects on workability.

Carbon (C) Content: 0.10% to 0.30%

Carbon (C) element is necessary for ensuring a satisfactory strength and improving the stability of retained γ. For ensuring a tensile strength of 1180 MPa or more, carbon is desirably contained in a content of 0.10% or more, and preferably 0.12% or more. However, carbon, if contained in an excessively high content, may cause the steel sheet to have excessively high strength after hot rolling to thereby have insufficient workability (e.g., cracking generation) or to have insufficient weldability. To avoid these, the carbon content is 0.30% or less and preferably 0.26% or less.

Silicon (Si) Content: 1.40% to 3.0%

Silicon (Si) element contributes as a solid-solution strengthening element to higher strength of the steel. The Si element also suppress the generation of carbides, effectively acts upon the formation of retained γ, and effectively contributes to satisfactory TS-EL balance. To exhibit these activities effectively, Si is desirably contained in a content of 1.40% or more, and preferably 1.50% or more. However, Si, if contained in an excessively high content, may cause significant scales upon hot rolling, may thereby cause the steel sheet to have scale marks on its surface and to have poor surface quality, and may impair pickling properties. To avoid these, the Si content is 3.0% or less and preferably 2.8% or less.

Manganese (Mn) Content: 0.5% to 3.0%

Manganese (Mn) element helps the steel sheet to have higher hardenability and to thereby have a higher strength. The Mn element also effectively stabilizes γ to form retained γ. To exhibit such activities effectively, Mn is desirably contained in a content of 0.5% or more, and preferably 0.6% or more. However, Mn, if contained in an excessively high content, may cause the steel sheet to have an excessively high strength after hot rolling to cause cracking and other problems, and may thereby cause poor workability or poor weldability. In addition, such excessive Mn may segregate to cause poor workability. To avoid these, the Mn content is 3.0% or less and preferably 2.6% or less.

Phosphorus (P) Content: 0.1% or Less

Phosphorus (P) element is inevitably contained in the steel sheet and adversely affects the weldability of the steel sheet. Accordingly, the phosphorus content should be 0.1% or less, preferably 0.08% or less, and more preferably 0.05% or less. The lower limit of the phosphorus content is not critical, because the phosphorus content is desirably minimized.

Sulfur (S) Content: 0.05% or Less

Sulfur (S) element is inevitably contained in the steel sheet and adversely affects the weldability of the steel sheet, as with phosphorus. In addition, sulfur forms sulfide inclusions in the steel sheet and thereby cause the steel sheet to have poor workability. To avoid these, the sulfur content is 0.05% or less, preferably 0.01% or less, and more preferably 0.005% or less. The lower limit of the sulfur content is not critical, because the sulfur content is desirably minimized.

Aluminum (Al) Content: 0.005% to 0.20%

Aluminum (Al) element acts as a deoxidizer. To exhibit such activities effectively, Al is desirably contained in a content of 0.005% or more. However, Al, if contained in an excessively high content, may cause the steel sheet to have remarkably inferior weldability. To avoid this, the Al content is 0.20% or less, preferably 0.15% or less, and more preferably 0.10% or less.

Nitrogen (N) Content: 0.01% or Less

Nitrogen (N) element is inevitably contained in the steel sheet, but forms nitride precipitates in the steel sheet and thereby helps the steel sheet to have a higher strength. However, nitrogen, if contained in an excessively high content, may cause large amounts of precipitated nitrides and may thereby cause the steel sheet to deteriorate in properties such as elongation, stretch flangeability (λ), and bendability (flexibility). To avoid these, the nitrogen content is 0.01% or less, preferably 0.008% or less, and more preferably 0.005% or less.

Oxygen (O) Content: 0.01% or Less

Oxygen (O) element is inevitably contained in the steel sheet and, if present in an excessively high content, may cause the steel sheet to have poor elongation and inferior bendability upon working. To avoid these, the oxygen content is 0.01% or less, preferably 0.005% or less, and more preferably 0.003% or less. The lower limit of the oxygen content is not critical, because the oxygen content is desirably minimized.

The steel sheet according to the present invention has the above-specified chemical composition, with the remainder being substantially iron and inevitable impurities. The inevitable impurities may include, for example, nitrogen (N) and oxygen (O) as mentioned above; and tramp elements such as Pb, Bi, Sb, and Sn, each of which may be brought into the steel typically from raw materials, construction materials, and manufacturing facilities. The steel sheet may positively further contain one or more of the following elements as additional elements within ranges not adversely affecting the operation of the present invention.

The steel sheet according to the present invention may further contain, as an additional element, at least one of following (A) to (E):

(A) chromium (Cr) in a content of 1.0% or less (excluding 0%) and/or molybdenum (Mo) in a content of 1.0% or less (excluding 0%);

(B) at least one element selected from the group consisting of titanium (Ti) in a content of 0.15% or less (excluding 0%), niobium (Nb) in a content of 0.15% or less (excluding 0%), and vanadium (V) in a content of 0.15% or less (excluding 0%);

(C) copper (Cu) in a content of 1.0% or less (excluding 0%) and/or nickel (Ni) in a content of 1.0% or less (excluding 0%);

(D) boron (B) in a content of 0.005% or less (excluding 0%); and (E) at least one element selected from the group consisting of calcium (Ca) in a content of 0.01% or less (excluding 0%), magnesium (Mg) in a content of 0.01% or less (excluding 0%), and one or more rare-earth elements (REM) in a content of 0.01% or less (excluding 0%). Each of element groups (A) to (E) may be contained alone or in arbitrary combination. The above-specified ranges of contents have been determined for the following reasons.

(A) Cr in a content of 1.0% or less (excluding 0%) and/or Mo in a content of 1.0% or less (excluding 0%)

Chromium (Cr) and molybdenum (Mo) elements are both effective for helping the steel sheet to have higher hardenability and to thereby have a higher strength, and each of Cr and Mo may be contained alone or in combination.

To exhibit such activities effectively, Cr and Mo may be contained each in a content of preferably 0.1% or more, and more preferably 0.2% or more. However, each of these elements, if contained in an excessively high content, may cause the steel sheet to have poor workability or to suffer from high cost. To avoid these, the content of Cr or Mo, if contained alone, is preferably 1.0% or less, more preferably 0.8% or less, and furthermore preferably 0.5% or less. When both Cr and Mo are contained, these elements are contained preferably in a total content of 1.5% or less whereas the Cr and Mo contents fall within the above specified ranges.

(B) At least one element selected from the group consisting of Ti in a content of 0.15% or less (excluding 0%), Nb in a content of 0.15% or less (excluding 0%), and V in a content of 0.15% or less (excluding 0%)

Titanium (Ti), niobium (Nb), and vanadium (V) elements each form precipitates of carbides or nitrides in the steel sheet thereby helps the steel sheet to have a higher strength, and allow prior austenite (priory) grains to be fine. These elements may be contained alone or in combination. To exhibit such activities effectively, the contents of Ti, Nb, and V are each preferably 0.01% or more, and more preferably 0.02% or more. However, these elements, if contained in excess, may precipitate as carbides at grain boundary and may cause the steel sheet to have inferior stretch flangeability and bendability. To avoid these, the contents of Ti, Nb and V are each preferably 0.15% or less, more preferably 0.12% or less, and furthermore preferably 0.1% or less.

(C) Cu in a content of 1.0% or less (excluding 0%) and/or Ni in a content of 1.0% or less (excluding 0%)

Copper (Cu) and nickel (Ni) elements effectively help retained austenite to be formed and stabilized; and each of these elements may be contained alone or in combination. To exhibit such activities, the contents of Cu and Ni are each preferably 0.05% or more, and more preferably 0.1% or more. However, Cu, if contained in excess, may cause the steel sheet to have inferior hot workability, and the content of Cu, when contained alone, is preferably 1.0% or less, more preferably 0.8% or less, and furthermore preferably 0.5% or less. Ni, if contained in excess, may cause higher cost, and the content of Ni is preferably 1.0% or less, more preferably 0.8% or less, and furthermore preferably 0.5% or less. Cu and Ni, when used in combination, more easily exhibit the activities; and Ni, when added, suppresses the deterioration in hot workability by the action of Cu. For these reasons, Cu and Ni, when used in combination, may be used in a total content of preferably 1.5% or less, and more preferably 1.0% or less; and Cu in this case may be contained in a content of preferably 0.7% or less, and more preferably 0.5%.

(D) B in a content of 0.005% or less (excluding 0%)

Boron (B) element helps the steel sheet to have higher hardenability and effectively helps austenite to be present stably down to room temperature. To exhibit such activities effectively, the boron content is preferably 0.0005% or more, and more preferably 0.001% or more. However, boron, if contained in excess, may form borides to cause the steel sheet to have inferior elongation. To avoid this, the boron content is preferably 0.005% or less, more preferably 0.004% or less, and furthermore preferably 0.003% or less.

(E) At least one element selected from the group consisting of Ca in a content of 0.01% or less (excluding 0%), Mg in a content of 0.01% or less (excluding 0%), and one or more rare-earth elements (REM) in a content of 0.01% or less (excluding 0%)

Calcium (Ca), magnesium (Mg), and REM (rare-earth element) elements help inclusions to be finely dispersed in the steel sheet, and each of these elements may be contained alone or in arbitral combination. To exhibit such activities effectively, the contents of Ca, Mg, and REM are each preferably 0.0005% or more, and more preferably 0.001% or more. However, these elements, if contained in excess, may cause the steel to have poor casting ability and hot workability. To avoid this, the contents of Ca, Mg, and REM are each preferably 0.01% or less, more preferably 0.005% or less, and furthermore preferably 0.003% or less.

As used herein the term "REM (rare-earth element)" refers to any of lanthanoid elements (15 elements ranging from lanthanum (La) to lutetium (Lu)) as well as Sc (scandium) and Y (yttrium).

Figure 2:
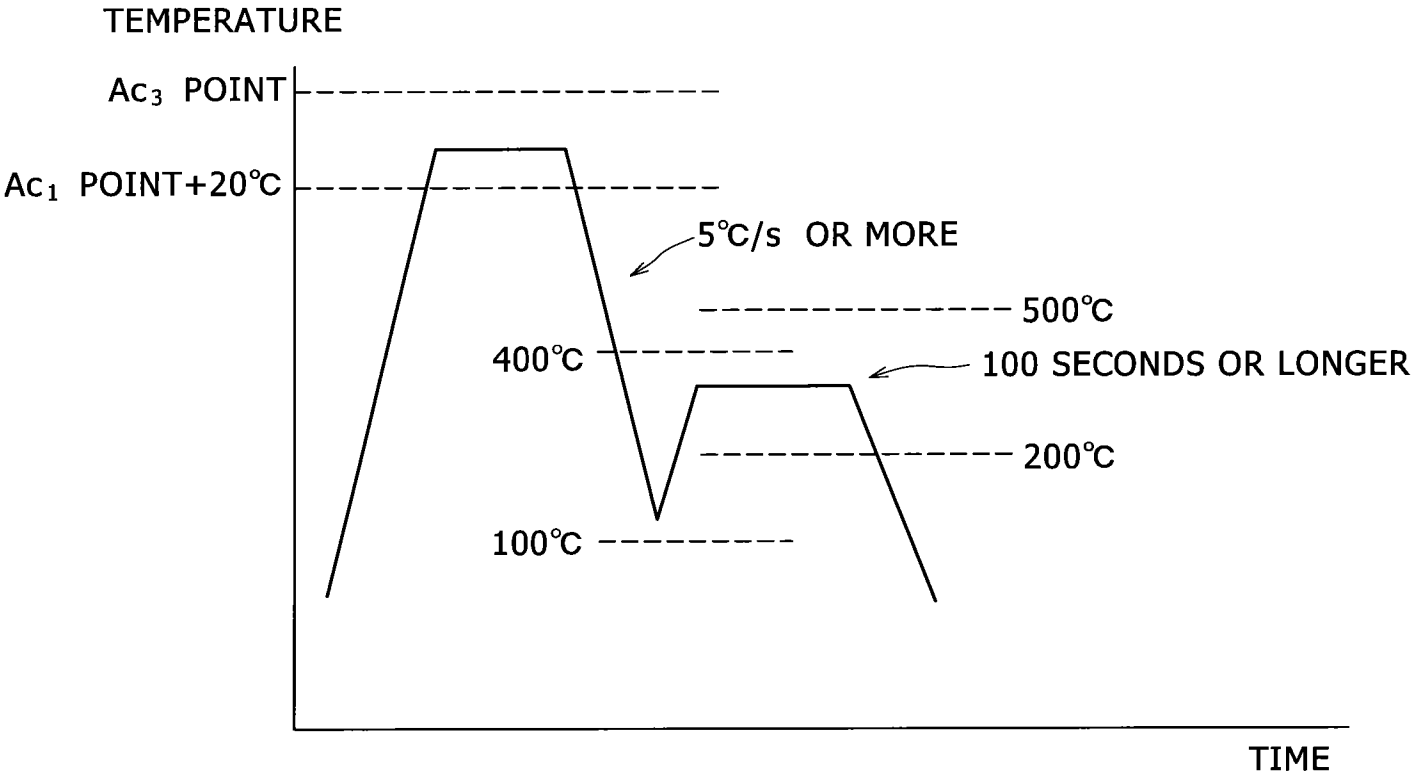
FIG. 2 is a schematic explanatory drawing illustrating an exemplary heat treatment pattern in a manufacturing method according to an embodiment of the present invention.
Figure 3:
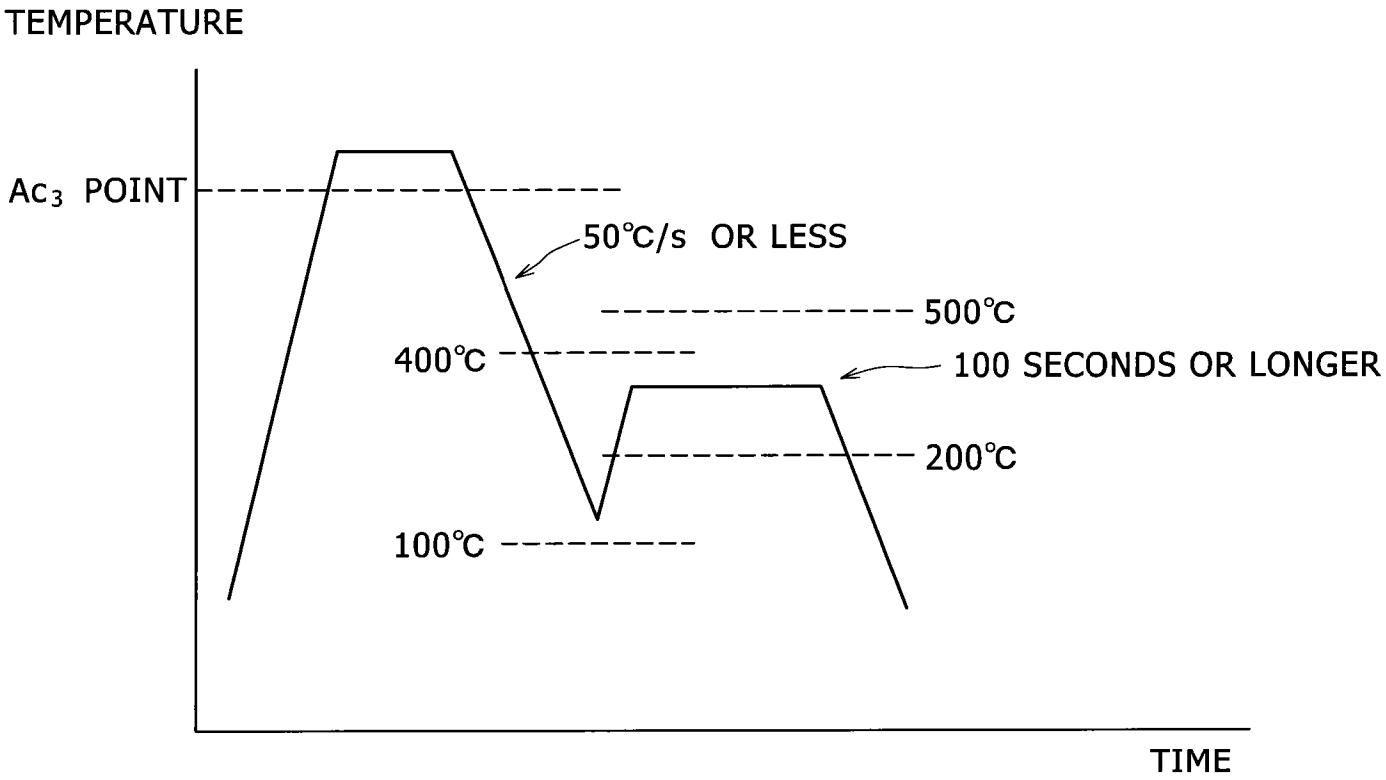
FIG. 3 is a schematic explanatory drawing illustrating another exemplary heat treatment pattern in a manufacturing method according to another embodiment of the present invention.

Next, methods for manufacturing the steel sheet according to the present invention will be described below. The high-strength steel sheet according to the present invention may be manufactured in the following manner. Initially, a steel having the above-specified chemical composition is hot-rolled according to a customary procedure, and the hot-rolled steel sheet is then subjected to any suitable combination of cold rolling, hot-dip galvanizing treatment, and alloying treatment (galvannealing) according to necessity, and the resulting steel sheet is subjected to an annealing process as being controlled as mentioned below, and thereby yields a high-strength steel sheet having a desired structure. Specifically, the high-strength steel sheet may be manufactured by preparing a hot-rolled steel sheet or cold-rolled steel sheet according to a customary procedure from a steel having the above-specified chemical composition; and (I) heating and soaking the rolled steel sheet at a temperature higher than the $Ac_1$ point by 20° C. or more and lower than the $Ac_3$ point; cooling the soaked steel sheet at an average cooling rate of 5° C./second or more to a temperature in the range of from 100° C. to 400° C.; and holding (austempering) the cooled steel sheet in a temperature range of from 200° C. to 500° C. for 100 seconds or longer, or (II) heating and soaking the rolled steel sheet at a temperature equal to or higher than the $Ac_3$ point; cooling the soaked steel sheet at an average cooling rate of 50° C./second or less to a temperature in the range of from 100° C. to 400° C.; and holding (austempering) the cooled steel sheet in a temperature range of from 200° C. to 500° C. for 100 seconds or longer. The steps (I) are illustrated in FIG. 2, and the steps (II) are illustrated in FIG. 3. The manufacturing methods (I) and (II) according to embodiments of the present invention will be illustrated in detail below.

Manufacturing Method (I):

Heating and Soaking at a Temperature Higher than the $Ac_1$ Point by 20° C. or More and Lower than the $Ac_3$ Point Soaking in a biphasic region at a temperature higher than the $Ac_1$ point by 20° C. or more and lower than the $Ac_3$ point (preferably at a temperature near to the temperature higher than the $Ac_1$ point by 20° C.) allows carbon (C) and manganese (Mn) in ferrite to migrate into austenite, thereby accelerates the formation of retained austenite having a high carbon content, and further improves elongation and other properties.

The amount of ferrite can be controlled by appropriately regulating the average cooling rate in the subsequent cooling process. Soaking, if performed at a holding temperature lower than the temperature higher than the $Ac_1$ point by 20° C. ($Ac_1$ point+20° C.), may cause the steel sheet as a final product to contain ferrite in excess in the metal structure and may not help the steel sheet to have a sufficient strength. In contrast, soaking, if performed at a holding temperature higher than the $Ac_3$ point, may fail to allow ferrite to form and grow sufficiently during soaking and may thereby fail to contribute improvements typically in elongation due to the formation of the retained austenite having a high carbon content.

Cooling at an average cooling rate of 5° C./second or more to a temperature in the range of from 100° C. to 400° C.

Subsequent to the soaking in the biphasic region, cooling is performed at a controlled cooling rate down from the soaking temperature, so as to control the amount of formed and grown ferrite. In particular, cooling herein is performed at a high cooling rate so as to suppress the formation and growth of ferrite, because ferrite has been formed during the soaking. Specifically, cooling is performed at an average cooling rate of 5° C./second or more from the soaking temperature down to a temperature in the range of from 100° C. to 400° C. Cooling, if performed at an average cooling rate of less than 5° C./second, may cause the steel sheet to have an excessively high ferrite content to thereby fail to ensure a satisfactory strength of 1180 MPa or more. The average cooling rate is preferably 7° C./second or more, and more preferably 10° C./second or more. The average cooling rate is not critical in its upper limit. Cooling may be performed typically through water cooling or oil cooling (oil quenching).

Manufacturing Method (II):

Soaking at a Temperature Equal to or Higher than the $Ac_3$ Point

Soaking, when performed in a single phase region at a temperature equal to or higher than the $Ac_3$ point, does not cause ferrite to form during the soaking. However, the subsequent cooling process, where the average cooling rate is controlled, allows ferrite to form and grow and allows the steel sheet to have a desired ferrite content, thus improving stability of manufacturing. The soaking temperature is preferably equal to or lower than a temperature higher than the $Ac_3$ point by 40° C. ($Ac_3$ point+40° C.), because soaking performed at an excessively high temperature may cause Si- and/or Mn-enriched layer to form in the surface layer of the steel sheet, thus impairing surface treatment properties.

Cooling at an average cooling rate of 50° C./second or less to a temperature in the range of from 100° C. to 400° C.

Subsequent to the soaking in the single phase region, cooling is performed at a controlled cooling rate down from the soaking temperature, so as to allow ferrite to form and grow and to control the amount of formed and grown ferrite. In particular, cooling herein is performed at a low cooling rate (as slow cooling) so as to allow ferrite to form and grow during cooling, because ferrite is not formed during the soaking. Specifically, the cooling is performed at an average cooling rate of 50° C./second or less from the soaking temperature down to a temperature in the range of from 100° C. to 400° C. Cooling performed at an average cooling rate of more than 50° C./second may not allow ferrite to form during cooling, and this may hinder the steel sheet from having satisfactory elongation. The average cooling rate preferably 45° C./second or less, and more preferably 40° C./second or less, so as to accelerate the formation and growth of ferrite during the cooling process. Though its lower limit is not critical, the average cooling rate is preferably 1° C./second or more, and more preferably 5° C./second or more, so as to suppress excessive formation and growth of ferrite during the cooling process.

Common Conditions in Manufacturing Methods (I) and (II)

Rate of Temperature Rise in Heating

The rate of temperature rise in heating up to the soaking temperature is not critical, may be chosen suitably, and may for example be an average rate of temperature rise of from about 0.5 to about 10° C./second.

Soaking Time

Though not critical, the holding time (soaking time) at the soaking temperature is preferably 80 seconds or longer, because soaking, if performed for an excessively short holding time, may cause deformation structure to remain, and this may cause the steel to have insufficient elongation.

Cooling Stop Temperature

It is significantly important in the present invention to set a cooling end-point temperature (cooling stop temperature; finish-cooling temperature) down from the soaking temperature to be in the range of from 100° C. to 400° C. The cooling finished at a cooling stop temperature of from 100° C. to 400° C. allows the MA constituent to have a volume fraction in the metal structure and to have a maximum size both within the above-specified ranges. This is because the cooling finished at a specific temperature allows part of untransformed austenite to transform into martensite, thereby introduces strain into the untransformed austenite to accelerate the untransformed austenite to transform into bainitic ferrite, and this may impede the formation of fresh martensite during cooling to room temperature.

Cooling, if finished at a cooling stop temperature of higher than 400° C., may fail to allow martensite to form sufficiently, may thereby fail to introduce strain into the untransformed austenite, and may fail to sufficiently accelerate the transformation into bainitic ferrite. As a result, the MA constituent may have a volume fraction and a maximum size higher than or larger than the above-specified ranges, and this may hinder the steel sheet from having desired resistance to cold brittleness. To avoid these, the cooling stop temperature is 400° C. or lower, preferably 350° C. or lower, and more preferably 300° C. or lower. Cooling, if finished at a cooling stop temperature of lower than 100° C., may cause most of untransformed austenite to transform into martensite, and this may impede the formation of a sufficient amount of the retained austenite and may cause the steel sheet to have poor elongation. To avoid these, the cooling stop temperature is 100° C. or higher, preferably 120° C. or higher, and more preferably 150° C. or higher.

When being higher than 300° C., the cooling stop temperature is preferably lower than the after-mentioned austempering temperature, for obtaining the structure specified in the present invention. When being 300° C. or lower, the cooling stop temperature may be equal to or higher than the austempering temperature.

Holding at a Temperature of from 200° C. to 500° C. for 100 Seconds or Longer

Subsequent to the cooling to a temperature in the above-specified range, the cooled steel sheet is held in a temperature range of from 200° C. to 500° C. for 100 seconds or longer. This holding process is also referred to as "austempering."

The holding in a specific temperature range for a predetermined time allows tempering of (fresh) martensite which has been formed as a result of the cooling, allows transformation of untransformed austenite into bainitic ferrite, and ensures a certain amount of the retained austenite. Austempering, if performed at a holding temperature of lower than 200° C., may not help transformation into bainitic ferrite to proceed sufficiently. This may cause the MA constituent to be present in an excessively large volume fraction and to have a maximum size not controlled within the desired range. Thus, the resulting steel sheet may have insufficient resistance to cold brittleness and/or may have insufficient elongation to adversely affect the workability. To avoid these, the holding temperature (austempering temperature) is 200° C. or higher, preferably 250° C. or higher, and more preferably 300° C. or higher. Austempering, if performed at a holding temperature of higher than 500° C., may cause untransformed austenite to decompose into ferrite and cementite. Thus, the steel sheet may fail to contain a sufficient volume fraction of retained austenite and may have an excessively high volume fraction of ferrite higher than the above-specified range. To avoid these, the holding temperature in austempering (austempering temperature) is 500° C. or lower, preferably 450° C. or lower, and more preferably 430° C. or lower.

Even at a temperature within the above range, austempering performed for an excessively short holding time may cause problems as in the austempering at an excessively low temperature. For example, transformation into bainitic ferrite may not be accelerated sufficiently. To avoid these problems and to effectively exhibit effects as in austempering at a holding temperature within the above range, austempering is performed at a holding temperature within the specific range for a holding time of 100 seconds or longer, preferably 150 seconds or longer, and more preferably 200 seconds or longer. Though not critical in its upper limit, the holding time is preferably 1500 seconds or less, and more preferably 1000 seconds or less, because austempering for an excessively long time may reduce the productivity and may impede the formation of retained γ due to precipitation of dissolved carbon.

Subsequent to the holding (austempering) for a predetermined time, the steel sheet is cooled to room temperature. The average cooling rate in this cooling process is not critical. Typically, the steel sheet may be cooled slowly or may be cooled at an average cooling rate of from about 1 to about 10° C./second.

As used herein the phrase "holding at a predetermined temperature" refers to that the steel sheet may not always necessarily be held at the same temperature but may be held at temperatures varying within the predetermined temperature range. Typically, when the steel sheet is cooled to the cooling stop temperature and is then held in the range of from 200° C. to 500° C., the steel sheet may be held at a constant temperature within the range of from 200° C. to 500° C. or may be held at temperatures varying within this range. The cooling stop temperature and the subsequent austempering temperature may be the same with each other, because the range of the cooling stop temperature partially overlaps the range of the austempering temperature. Specifically, when the cooling stop temperature falls within the range of austempering holding temperature (200° C. to 500° C.), the work may be held at that temperature for a predetermined time without heating (or cooling), or may be heated (or cooled) to a temperature within the temperature range and then held at that temperature for a predetermined time. When the work is heated from the cooling stop temperature, the average rate of temperature rise is not critical and may for example be from about 0 to about 10° C./second.

The $Ac_1$ point and the Acs point may be calculated according to the following equations (a) and (b) described by William C. Leslie in "The Physical Metallurgy of Steels" (Maruzen Co., Ltd., May 31, 1985, pp. 273). In the equations, the data in the square brackets represent contents (percent by weight) of respective elements, and calculation may be performed assuming that the content of an element not contained in the steel sheet be 0 percent by mass.

$$Ac_1(°\ C.)=723-10.7\times[Mn]-16.9\times[Ni]+29.1\times[Si]+16.9\times[Cr]+290\times[As]+6.38\times[W] \quad (a)$$

$$Ac_3(°\ C.)=910-203\times[C]^{1/2}-15.2\times[Ni]+44.7\times[Si]+104\times[V]+31.5\times[Mo]+13.1\times[W]-(30\times[Mn]+11\times[Cr]+20\times[Cu]-700\times[P]-400\times[Al]-120\times[As]-400\times[Ti]) \quad (b)$$

The technique according to the present invention is advantageously applicable particularly to thin steel sheets each having a thickness of 6 mm or less.

Examples

The present invention will be illustrated in further detail with reference to several working examples below. It should be noted, however, that these examples are never intended to limit the scope of the present invention; various alternations and modifications may be made without departing from the scope and spirit of the present invention and fall within the technical scope of the present invention.

A series of steels having chemical compositions given in Table 1 (the remainder being iron and inevitable impurities, units in the table are "percent by mass") was melted and cast in vacuo into steel ingots, formed into slabs, and the slabs were each subjected sequentially to hot rolling, cold rolling, and continuous annealing under the following conditions, and thereby yielded steel sheets having a thickness of 1.4 mm as specimens.

Hot Rolling

The slabs were heated to 1250° C., held at that temperature for 30 minutes, subjected to hot rolling to a rolling reduction of 90% at a finish rolling temperature of 920° C., cooled from that temperature down to a coiling temperature of 500° C. at an average cooling rate of 30° C./second, and coiled. After coiling, the works were held at the coiling temperature of 500° C. for 30 minutes, cooled to room temperature in the furnace, and thereby yielded a series of hot-rolled sheets having a thickness of 2.6 mm.

Cold Rolling

The above-prepared hot-rolled steel sheets were subjected to acid wash to remove scales on the surface, then subjected to cold rolling to a cold rolling reduction of 46%, and thereby yielded a series of cold-rolled steel sheets having a thickness of 1.4 mm.

Continuous Annealing

The steel sheets after cold rolling were subjected to continuous annealing (i.e., sequentially to soaking, cooling, and austempering) under conditions given in Tables 2 and 3 and thereby yielded the specimens. In Tables 2 and 3, the temperature at which soaking (holding) was performed is indicated as "soaking temperature (° C.)"; the average cooling rate after soaking down to the cooling stop temperature is indicated as "cooling rate (° C./s)"; the cooling stop temperature after soaking is indicated as "cooling stop temperature (° C.)"; the rate of temperature rise from the cooling stop temperature up to the austempering temperature is indicated as "rate of temperature rise (° C./s)"; the range of austempering temperature(s) is indicated as "austempering temperature (° C.)"; and the holding time (second) within the range of austempering temperature is indicated as "austempering time (s)." After held at a temperature or temperatures within the range of austempering temperature for a predetermined time, the works were air-cooled to room temperature.

The respective specimens were examined on metal structure (ferrite, MA constituent, the remainder structure, maximum size of MA constituent, and retained γ), yield strength (YS in MPa), tensile strength (TS in MPa), elongation (EL in %), balance between tensile strength and elongation (TS×EL), resistance to cold brittleness (absorbed energy at room temperature and −40° C. in J) under conditions mentioned below.

Metal Structure (Ferrite, Retained γ, MA Constituent, Maximum Size of MA Constituent, and Remainder Structure):

The metal structure was examined by cutting a cross section in parallel with the rolling direction at a position of depth one-quarter the thickness of the steel sheet as a specimen, subjecting the specimen to polishing, further electropolishing, and etching, and observing the resulting specimen under an optical microscope and a scanning electron microscope (SEM).

Photographs of the metal structure taken by the SEM and optical microscope were subjected to image analyses to measure the volume fractions of the respective structures and the maximum size of the MA constituent.

Volume Fraction of Ferrite (Indicated as "Ferrite (%)" in the Tables)

Each of the specimens was electropolished, etched (corroded) with a Nital solution (solution of nitric acid in alcohol), observed under a SEM (at 1000-fold magnification) in three view fields (each view field having a size of 100 μm long and 100 μm wide), the volume fraction of ferrites were measured by point counting at a grid spacing of 5 μm in a number of grid points of 20×20, and the measured volume fractions of ferrites were averaged.

Volume Fraction of MA Constituent (Indicated as "MA (%)" in the Tables)

Each of the specimens was electropolished, etched with LePera reagent, observed under an optical microscope (at 1000-fold magnification) in three view fields (each view field having a size of 100 μm long and 100 μm wide), the volume fractions of the MA constituent were measured by point counting at a grid spacing of 5 μm in a number of grid points of 20×20, and the measured volume fraction of MA constituents were averaged. A portion having been whitened as a result of LePera etching was observed as a MA constituent.

Maximum Size of MA Constituent (Indicated as "Maximum MA Size (μm)" in the Tables)

In the same manner as in the measurement of the volume fraction of MA constituent, each of the specimens was etched with LePera reagent, observed under an optical microscope (at 1000-fold magnification) in three view fields (each view field having a size of 100 μm long and 100 μm wide), MA constituents having the largest size in the respective view fields were measured, the three largest sizes of the MA constituents in the three view fields were averaged, and the average was defined as the maximum size of MA constituent.

Remainder Structure (not Indicated in the Tables)

The remainder structure was also observed and found to be bainitic ferrite and/or tempered martensite.

Volume Fraction of Retained γ (Indicated as "γ(%)" in the Tables)

Each of the specimens were polished to a position of a depth one-quarter the thickness of the steel sheet using sand paper of #1000 to #1500, the surface of which was further electropolished to a depth of from about 10 to about 20 μm, and the volume fraction of retained γ was measured using an X-ray diffractometer (RINT 1500, Rigaku Corporation). Specifically, the measurement was performed in the range in terms of 20 of from 40° to 130° using a cobalt (Co) target at an output of about 40 kV and about 200 mA, and retained γ was quantitatively measured based on the measured (110), (200), and (211) bcc (α) diffraction peaks, and on (111), (200), (220), and (311) fcc (γ) diffraction peaks.

Yield Strength (YS in MPa), Tensile Strength (TS in MPa), Elongation (EL in %), Balance Between Tensile Strength and Elongation (TS×EL).

For measuring mechanical properties of the specimens, tensile tests prescribed in JIS Z2201 were performed using No. 5 test specimens, and yield strength (YS in MPa), tensile strength (TS in MPa), and elongation (EL in %) were measured. The test specimens were cut from the specimens so that the longitudinal direction of each test specimen be a direction perpendicular to the rolling direction. The balance between tensile strength and elongation (TS-EL balance; TS×EL) was determined by calculation from the measured tensile strength and elongation.

In the present invention, samples having a tensile strength (TS) of 1180 MPa or more were evaluated as having high strength (accepted); whereas samples having a TS of less than 1180 MPa were evaluated as having insufficient strengths (rejected).

On elongation (EL in %), samples having an elongation of 13% or more were evaluated as having satisfactory elongation (accepted); whereas samples having an elongation of less than 13% were evaluated as having insufficient elongation (rejected).

On balance between strength and elongation (TS×EL), samples having a TS×EL of 17000 or more were evaluated as having satisfactory balance between strength and elongation (accepted); whereas samples having a TS×EL of less than 17000 were evaluated as having insufficient balance between strength and elongation (rejected).

Resistance to Cold Brittleness (Absorbed Energy at Room Temperature and −40° C. in J):

The resistance to cold brittleness was evaluated by preparing JIS No. 4 Charpy specimens prescribed in the Charpy impact test (JIS Z2224), the Charpy specimens were subjected to Charpy tests each twice at room temperature and at −40° C., and the area percentage of brittle fracture and the absorbed energy (J) were measured. Samples having an average absorbed energy (joule; J) at −40° C. of 9 J or more were evaluated as having satisfactory resistance to cold brittleness (accepted). The Charpy tests at room temperature were performed for reference purposes.

The steel sheets after cold rolling obtained from Steel Y and Steel Z suffered from cracking and became defective, and they were not subjected to subsequent continuous annealing. These steel sheets suffered from cracking probably because Steel Y (having excessively high carbon and silicon contents) and Steel Z (having an excessively high manganese content) are samples having chemical compositions not satisfying the conditions specified in the present invention, and the steel sheets obtained therefrom after hot rolling have excessively high strengths.

TABLE 1

| Steel Type | C | Si | Mn | P | S | Al | N | O | Additional element | $Ac_1$ (° C.) | $Ac_1$ + 20 (° C.) | $Ac_3$ (° C.) |
|---|---|---|---|---|---|---|---|---|---|---|---|---|
| A | 0.19 | 2.0 | 2.6 | 0.01 | 0.001 | 0.04 | 0.003 | 0.001 | Ti: 0.015 | 753 | 773 | 863 |
| B | 0.18 | 2.0 | 2.6 | 0.01 | 0.001 | 0.04 | 0.003 | 0.001 | | 753 | 773 | 858 |
| C | 0.10 | 3.0 | 3.0 | 0.01 | 0.002 | 0.03 | 0.004 | 0.001 | B: 0.0001 | 778 | 798 | 909 |
| D | 0.30 | 1.4 | 0.5 | 0.01 | 0.002 | 0.03 | 0.003 | 0.001 | | 758 | 778 | 865 |
| E | 0.21 | 2.1 | 2.4 | 0.02 | 0.001 | 0.03 | 0.003 | 0.001 | Cr: 0.06 | 759 | 779 | 864 |
| F | 0.19 | 2.2 | 2.6 | 0.01 | 0.001 | 0.04 | 0.004 | 0.001 | Mo: 0.20 | 759 | 779 | 871 |
| G | 0.18 | 2.4 | 2.7 | 0.02 | 0.001 | 0.04 | 0.003 | 0.001 | Cr: 1.0, Mo: 0.03 | 781 | 801 | 870 |
| H | 0.17 | 2.1 | 2.9 | 0.01 | 0.002 | 0.04 | 0.003 | 0.001 | Ti: 0.05 | 753 | 773 | 876 |
| I | 0.18 | 2.1 | 2.6 | 0.01 | 0.001 | 0.03 | 0.003 | 0.001 | V: 0.15, Ca: 0.0025, Mg: 0.0013 | 756 | 776 | 874 |
| J | 0.16 | 1.7 | 2.6 | 0.02 | 0.001 | 0.04 | 0.004 | 0.001 | Mo: 1.0, Ca: 0.0030, REM: 0.0015 (La: 0.0005, Sc: 0.0005, Sm: 0.0005) | 745 | 765 | 888 |
| K | 0.22 | 1.6 | 2.4 | 0.02 | 0.001 | 0.04 | 0.003 | 0.001 | Nb: 0.15 | 744 | 764 | 844 |
| L | 0.18 | 1.8 | 2.6 | 0.01 | 0.002 | 0.03 | 0.003 | 0.001 | Ti: 0.15, B: 0.0050, Mg: 0.0010 | 748 | 768 | 905 |
| M | 0.13 | 2.9 | 2.0 | 0.01 | 0.002 | 0.03 | 0.003 | 0.001 | Ti: 0.02, Nb: 0.04, REM: 0.0022 (Y: 0.0005, Ce: 0.0007, Er: 0.0005, La: 0.0005) | 786 | 806 | 933 |

TABLE 1-continued

| Steel Type | C | Si | Mn | P | S | Al | N | O | Additional element | $Ac_1$ (° C.) | $Ac_1$ + 20 (° C.) | $Ac_3$ (° C.) |
|---|---|---|---|---|---|---|---|---|---|---|---|---|
| N | 0.24 | 2.0 | 2.6 | 0.01 | 0.001 | 0.04 | 0.003 | 0.001 | Cr: 0.05, Cu: 0.10 | 754 | 774 | 842 |
| O | 0.21 | 2.2 | 2.6 | 0.02 | 0.001 | 0.04 | 0.003 | 0.001 | Ti: 0.03, V: 0.01, REM: 0.0010 (Y: 0.0003, Sm: 0.0005, La: 0.0002) | 759 | 779 | 880 |
| P | 0.25 | 1.5 | 2.6 | 0.01 | 0.001 | 0.03 | 0.003 | 0.001 | Mg: 0.010 | 739 | 759 | 817 |
| Q | 0.26 | 1.6 | 2.6 | 0.01 | 0.002 | 0.03 | 0.003 | 0.001 | Cr: 0.30, Ni: 0.10 | 745 | 765 | 814 |
| R | 0.28 | 3.0 | 0.5 | 0.01 | 0.002 | 0.04 | 0.005 | 0.001 | Ca: 0.010 | 805 | 825 | 945 |
| S | 0.19 | 2.0 | 2.6 | 0.02 | 0.002 | 0.04 | 0.003 | 0.001 | Ti: 0.05, B: 0.0020 | 753 | 773 | 883 |
| T | 0.19 | 2.0 | 2.6 | 0.01 | 0.001 | 0.04 | 0.003 | 0.001 | Cu: 0.50, Ni: 0.50, Ca: 0.0030 | 745 | 765 | 828 |
| U | 0.20 | 2.2 | 2.6 | 0.01 | 0.001 | 0.04 | 0.003 | 0.001 | Cu: 0.5, Ni: 1.0 | 742 | 762 | 827 |
| V | 0.07 | 1.8 | 2.6 | 0.02 | 0.002 | 0.03 | 0.003 | 0.001 | | 748 | 768 | 885 |
| W | 0.19 | 1.2 | 2.4 | 0.01 | 0.001 | 0.04 | 0.002 | 0.001 | | 732 | 752 | 826 |
| X | 0.19 | 2.0 | 0.4 | 0.01 | 0.002 | 0.04 | 0.002 | 0.001 | | 777 | 797 | 922 |
| Y | 0.35 | 3.5 | 2.3 | 0.02 | 0.001 | 0.03 | 0.001 | 0.001 | | 800 | 820 | 903 |
| Z | 0.18 | 1.9 | 3.5 | 0.01 | 0.002 | 0.03 | 0.003 | 0.001 | | 741 | 761 | 823 |

TABLE 2

| Test No | Steel Type | $Ac_1$ + 20 (° C.) | $Ac_3$ (° C.) | Soaking temperature (° C.) | Cooling rate (° C./s) | Cooling stop temperature (° C.) | Rate of temperature rise (° C./s) | Austempering temperature (° C.) | Austempering time (s) |
|---|---|---|---|---|---|---|---|---|---|
| 1 | A | 773 | 863 | 815 | 20 | 125 | 1 | 350 | 700 |
| 2 | A | 773 | 863 | 815 | 20 | 150 | 1 | 350 | 700 |
| 3 | A | 773 | 863 | 815 | 20 | 175 | 1 | 350 | 700 |
| 4 | A | 773 | 863 | 815 | 20 | 200 | 1 | 350 | 700 |
| 5 | A | 773 | 863 | 815 | 20 | 225 | 1 | 350 | 700 |
| 6 | A | 773 | 863 | 820 | 15 | 150 | 1 | 400 | 900 |
| 7 | A | 773 | 863 | 820 | 15 | 180 | 1 | 400 | 900 |
| 8 | A | 773 | 863 | 820 | 15 | 220 | 1 | 350 | 900 |
| 9 | A | 773 | 863 | 830 | 5 | 175 | 1 | 350 | 900 |
| 10 | A | 773 | 863 | 830 | 10 | 175 | 1 | 350 | 900 |
| 11 | A | 773 | 863 | 830 | 15 | 200 | 1 | 400 | 900 |
| 12 | A | 773 | 863 | 830 | 20 | 125 | 1 | 350 | 700 |
| 13 | A | 773 | 863 | 840 | 15 | 180 | 1 | 400 | 900 |
| 14 | A | 773 | 863 | 845 | 20 | 150 | 1 | 350 | 700 |
| 15 | A | 773 | 863 | 845 | 20 | 175 | 1 | 350 | 700 |
| 16 | A | 773 | 863 | 845 | 20 | 200 | 1 | 350 | 700 |
| 17 | A | 773 | 863 | 845 | 20 | 225 | 1 | 350 | 700 |
| 18 | A | 773 | 863 | 860 | 15 | 260 | 1 | 400 | 900 |
| 19 | A | 773 | 863 | 860 | 20 | 200 | 1 | 350 | 700 |
| 20 | A | 773 | 863 | 860 | 20 | 225 | 1 | 350 | 700 |
| 21 | A | 773 | 863 | 870 | 15 | 260 | 1 | 430 | 900 |
| 22 | B | 773 | 858 | 830 | 20 | 200 | 1 | 350 | 700 |
| 23 | C | 798 | 909 | 830 | 20 | 175 | 1 | 350 | 700 |
| 24 | C | 798 | 909 | 840 | 15 | 220 | 1 | 300 | 900 |
| 25 | D | 778 | 865 | 830 | 25 | 175 | 1 | 350 | 900 |
| 26 | D | 778 | 865 | 860 | 20 | 260 | 1 | 400 | 650 |
| 27 | E | 779 | 864 | 820 | 15 | 200 | 1 | 350 | 900 |
| 28 | E | 779 | 864 | 830 | 20 | 225 | 1 | 350 | 700 |
| 29 | F | 779 | 871 | 830 | 20 | 200 | 1 | 350 | 700 |
| 30 | G | 801 | 870 | 820 | 15 | 150 | 1 | 430 | 900 |
| 31 | G | 801 | 870 | 830 | 20 | 175 | 1 | 350 | 900 |

TABLE 3

| Test No | Steel Type | $Ac_1$ + 20 (° C.) | $Ac_3$ (° C.) | Soaking temperature (° C.) | Cooling rate (° C./s) | Cooling stop temperature (° C.) | Rate of temperature rise (° C./s) | Austempering temperature (° C.) | Austempering time (s) |
|---|---|---|---|---|---|---|---|---|---|
| 32 | H | 773 | 876 | 830 | 20 | 175 | 1 | 350 | 1000 |
| 33 | H | 773 | 876 | 830 | 20 | 175 | 1 | 350 | 600 |
| 34 | I | 776 | 874 | 830 | 15 | 175 | 1 | 350 | 900 |
| 35 | L | 768 | 905 | 830 | 20 | 150 | 1 | 350 | 700 |
| 36 | J | 765 | 888 | 860 | 20 | 150 | 1 | 350 | 700 |
| 37 | K | 765 | 844 | 840 | 15 | 220 | 1 | 400 | 900 |
| 38 | M | 806 | 933 | 880 | 20 | 150 | 1 | 300 | 900 |
| 39 | N | 774 | 842 | 810 | 15 | 250 | 1 | 400 | 700 |
| 40 | O | 779 | 880 | 830 | 15 | 250 | 1 | 400 | 900 |
| 41 | P | 759 | 817 | 820 | 15 | 200 | 1 | 420 | 900 |
| 42 | Q | 765 | 814 | 830 | 15 | 200 | 1 | 420 | 900 |

TABLE 3-continued

| Test No | Steel Type | $Ac_1$ + 20 (° C.) | $Ac_3$ (° C.) | Soaking temperature (° C.) | Cooling rate (° C./s) | Cooling stop temperature (° C.) | Rate of temperature rise (° C./s) | Austempering temperature (° C.) | Austempering time (s) |
|---|---|---|---|---|---|---|---|---|---|
| 43 | R | 825 | 945 | 830 | 15 | 240 | 1 | 400 | 700 |
| 44 | S | 773 | 883 | 845 | 20 | 250 | 1 | 350 | 700 |
| 45 | T | 765 | 838 | 860 | 20 | 250 | 1 | 350 | 700 |
| 46 | U | 762 | 827 | 830 | 15 | 250 | 1 | 400 | 900 |
| 47 | V | 798 | 885 | 830 | 15 | 250 | 1 | 400 | 900 |
| 48 | W | 752 | 826 | 830 | 15 | 250 | 1 | 400 | 900 |
| 49 | X | 820 | 922 | 830 | 15 | 200 | 1 | 400 | 900 |
| 50 | A | 773 | 863 | 755 | 15 | 200 | 1 | 400 | 900 |
| 51 | A | 773 | 863 | 830 | 15 | 90 | 1 | 400 | 900 |
| 52 | A | 773 | 863 | 830 | 15 | 420 | 0 | 420 | 900 |
| 53 | A | 773 | 863 | 830 | 15 | 200 | 1 | 80 | 700 |
| 54 | A | 773 | 863 | 830 | 15 | 200 | 1 | 520 | 700 |
| 55 | A | 773 | 863 | 830 | 15 | 200 | 1 | 400 | 70 |
| 56 | A | 773 | 863 | 830 | 3 | 200 | 1 | 350 | 700 |
| 57 | B | 773 | 858 | 820 | 40 | 200 | 1 | 370 | 500 |
| 58 | B | 773 | 858 | 870 | 60 | 300 | 1 | 400 | 500 |
| 59 | B | 773 | 858 | 830 | 20 | 300 | 0 | 300 | 500 |
| 60 | D | 778 | 865 | 840 | 15 | 300 | 0 | 300 | 1000 |
| 61 | D | 778 | 865 | 810 | 5 | 300 | 0 | 300 | 700 |

TABLE 4

| Test No | YS (MPa) | TS (MPa) | EL (%) | TS × EL | Ferrite (%) | γ (%) | MA (%) | Maximum MA size (μm) | Absorbed energy at −40° C. (J) | Absorbed energy at room temperature (J) |
|---|---|---|---|---|---|---|---|---|---|---|
| 1 | 951 | 1304 | 14.3 | 18579 | 21 | 12 | 2 | 3 | 9 | 10 |
| 2 | 905 | 1280 | 15.1 | 19323 | 21 | 12 | 3 | 4 | 9 | 9 |
| 3 | 867 | 1257 | 16.9 | 21241 | 20 | 12 | 5 | 4 | 9 | 10 |
| 4 | 821 | 1242 | 16.9 | 20932 | 18 | 11 | 5 | 6 | 9 | 9 |
| 5 | 736 | 1224 | 17.1 | 20873 | 18 | 11 | 2 | 4 | 9 | 9 |
| 6 | 957 | 1208 | 17.3 | 20831 | 25 | 11 | 1 | 1.5 | 9 | 10 |
| 7 | 910 | 1187 | 19.1 | 22614 | 19 | 12 | 4 | 3 | 10 | 9 |
| 8 | 836 | 1204 | 18.5 | 22265 | 10 | 10 | 4 | 2 | 10 | 10 |
| 9 | 862 | 1255 | 16.3 | 20450 | 23 | 12 | 5 | 5 | 9 | 9 |
| 10 | 866 | 1247 | 16.8 | 20886 | 17 | 11 | 1 | 2 | 9 | 9 |
| 11 | 929 | 1183 | 19.5 | 23072 | 19 | 11 | 2 | 2 | 9 | 9 |
| 12 | 943 | 1294 | 14.9 | 19285 | 17 | 11 | 4 | 2 | 10 | 9 |
| 13 | 949 | 1196 | 18.2 | 21706 | 15 | 11 | 1 | 3 | 10 | 9 |
| 14 | 942 | 1284 | 14.9 | 19061 | 14 | 10 | 2 | 2 | 10 | 10 |
| 15 | 922 | 1271 | 15.7 | 19890 | 16 | 10 | 4 | 2 | 10 | 10 |
| 16 | 880 | 1245 | 15.6 | 19414 | 15 | 10 | 3 | 3 | 10 | 10 |
| 17 | 846 | 1232 | 16.4 | 20144 | 16 | 11 | 3 | 4 | 10 | 10 |
| 18 | 931 | 1187 | 17.4 | 20654 | 14 | 11 | 4 | 6 | 10 | 10 |
| 19 | 996 | 1298 | 13.2 | 17138 | 12 | 11 | 3 | 5 | 10 | 9 |
| 20 | 983 | 1293 | 13.2 | 17066 | 10 | 11 | 3 | 7 | 10 | 10 |
| 21 | 1043 | 1229 | 15.7 | 19241 | 7 | 9 | 2 | 2 | 11 | 10 |
| 22 | 818 | 1234 | 16.2 | 19994 | 20 | 10 | 4 | 3 | 9 | 9 |
| 23 | 887 | 1264 | 16.2 | 20417 | 16 | 11 | 6 | 6 | 9 | 9 |
| 24 | 763 | 1256 | 16.1 | 20164 | 16 | 10 | 4 | 3 | 9 | 10 |
| 25 | 956 | 1296 | 15.0 | 19377 | 12 | 11 | 2 | 1 | 9 | 10 |
| 26 | 986 | 1190 | 16.3 | 19341 | 9 | 10 | 3 | 1 | 9 | 9 |
| 27 | 889 | 1217 | 18.3 | 22202 | 18 | 10 | 4 | 3 | 9 | 9 |
| 28 | 826 | 1234 | 16.9 | 20797 | 16 | 11 | 1 | 2 | 9 | 9 |
| 29 | 1013 | 1308 | 14.1 | 18443 | 18 | 10 | 5 | 3 | 9 | 9 |
| 30 | 921 | 1188 | 17.7 | 21028 | 17 | 10 | 1 | 1 | 9 | 9 |
| 31 | 926 | 1273 | 16.4 | 20809 | 12 | 10 | 3 | 4 | 9 | 9 |

TABLE 5

| Test No | YS (MPa) | TS (MPa) | EL (%) | TS × EL | Ferrite (%) | γ (%) | MA (%) | Maximum MA size (μm) | Absorbed energy at −40° C. (J) | Absorbed energy at room temperature (J) |
|---|---|---|---|---|---|---|---|---|---|---|
| 32 | 903 | 1259 | 16.2 | 20340 | 15 | 10 | 5 | 3 | 9 | 10 |
| 33 | 899 | 1269 | 16.0 | 20297 | 14 | 10 | 4 | 3 | 9 | 10 |
| 34 | 887 | 1258 | 16.7 | 21009 | 14 | 10 | 6 | 5 | 9 | 9 |
| 35 | 916 | 1281 | 16.1 | 20559 | 18 | 11 | 2 | 2 | 9 | 9 |
| 36 | 923 | 1183 | 15.8 | 18691 | 5 | 9 | 2 | 3 | 10 | 10 |
| 37 | 934 | 1194 | 14.5 | 17313 | 10 | 10 | 3 | 4 | 9 | 9 |
| 38 | 901 | 1184 | 17.9 | 21194 | 5 | 9 | 6 | 2 | 9 | 9 |
| 39 | 1022 | 1289 | 14.1 | 18175 | 18 | 11 | 5 | 6 | 9 | 9 |

TABLE 5-continued

| Test No | YS (MPa) | TS (MPa) | EL (%) | TS × EL | Ferrite (%) | γ (%) | MA (%) | Maximum MA size (μm) | Absorbed energy at −40° C. (J) | Absorbed energy at room temperature (J) |
|---|---|---|---|---|---|---|---|---|---|---|
| 40 | 921 | 1214 | 18.9 | 22945 | 15 | 10 | 4 | 7 | 10 | 10 |
| 41 | 968 | 1199 | 15.4 | 18465 | 18 | 11 | 3 | 6 | 10 | 10 |
| 42 | 1025 | 1287 | 14.7 | 18919 | 15 | 11 | 2 | 5 | 9 | 10 |
| 43 | 942 | 1194 | 14.5 | 17313 | 19 | 11 | 5 | 4 | 9 | 10 |
| 44 | 785 | 1222 | 16.2 | 19728 | 14 | 11 | 4 | 4 | 10 | 10 |
| 45 | 890 | 1258 | 13.8 | 17358 | 15 | 11 | 6 | 7 | 10 | 10 |
| 46 | 902 | 1240 | 17.6 | 21824 | 22 | 12 | 5 | 5 | 10 | 10 |
| 47 | 765 | 1154 | 11.3 | 13040 | 25 | 3 | 0 | 0 | 9 | 9 |
| 48 | 964 | 1188 | 13.4 | 15919 | 15 | 10 | 2 | 4 | 10 | 10 |
| 49 | 841 | 1152 | 12.2 | 14054 | 14 | 4 | 2 | 2 | 9 | 9 |
| 50 | 587 | 1023 | 20.5 | 20972 | 36 | 13 | 7 | 8 | 7 | 10 |
| 51 | 1180 | 1360 | 11.1 | 15096 | 20 | 4 | 1 | 1 | 9 | 9 |
| 52 | 803 | 1210 | 14.7 | 17787 | 19 | 10 | 10 | 8 | 6 | 10 |
| 53 | 1167 | 1382 | 12.5 | 17275 | 21 | 10 | 11 | 9 | 5 | 10 |
| 54 | 782 | 1180 | 13.2 | 15576 | 17 | 3 | 2 | 2 | 10 | 9 |
| 55 | 830 | 1211 | 16.3 | 19739 | 18 | 10 | 12 | 9 | 3 | 10 |
| 56 | 764 | 1154 | 18.2 | 21003 | 39 | 10 | 10 | 10 | 5 | 10 |
| 57 | 830 | 1223 | 17.4 | 21280 | 23 | 11 | 4 | 3 | 10 | 10 |
| 58 | 1120 | 1346 | 11.5 | 15479 | 1 | 9 | 10 | 9 | 6 | 9 |
| 59 | 851 | 1191 | 16.8 | 20009 | 18 | 10 | 5 | 4 | 9 | 9 |
| 60 | 800 | 1214 | 16.9 | 20517 | 19 | 10 | 5 | 5 | 9 | 9 |
| 61 | 815 | 1180 | 18.7 | 22066 | 24 | 10 | 4 | 4 | 10 | 10 |

Test Nos. 1 to 46, 57, and 59 to 61 are samples manufactured from steels having chemical compositions within the range specified in the present invention by performing heat treatments under annealing conditions specified in the present invention. Test Nos. 1 to 46, 57, and 59 to 61 each have metal structures specified in the present invention, excel in elongation even having high tensile strengths of 1180 MPa or more, and have good TS-EL balance. These samples have satisfactory resistance to cold brittleness at −40° C.

Test No. 47 is a sample having an excessively low carbon content, and Test No. 49 is a sample having an excessively low Mn content. These samples, as having chemical compositions out of the range specified in the present invention, give steel sheets having excessively small volume fractions of retained γ. In addition, Test No. 47 does not contain MA constituent. Test Nos. 47 and 49 fail to have satisfactory tensile strengths of 1180 MPa or more and are poor in TS-EL balance.

Test No. 48 is a sample having an excessively low Si content, thereby has a chemical composition out of the range specified in the present invention, and gives a steel sheet having poor TS-EL balance.

Test No. 50 is a sample undergone soaking at a soaking temperature (755° C.) lower than ($Ac_1$+20)° C. (773° C.) and thereby fails to give a metal structure specified in the present invention. Specifically, this sample has excessively high volume fractions of ferrite and MA constituent and has an excessively large maximum size of MA constituent. Accordingly, this sample fails to have a satisfactory tensile strength of 1180 MPa or more and has poor resistance to cold brittleness.

Test No. 51 is a sample undergone cooling at a cooling stop temperature (90° C.) lower than 100° C., thereby fails to have a sufficient volume fraction of retained γ, and has poor TS-EL balance.

Test No. 52 is a sample undergone cooling at a cooling stop temperature (420° C.) higher than 400° C., has an excessively high volume fraction of MA constituent (10 percent by volume), has an excessively large maximum size of MA constituent, and has poor resistance to cold brittleness.

Test No. 53 is a sample undergone austempering at an excessively low holding temperature (80° C.), thereby has an excessively high volume fraction of MA constituent (11 percent by volume), has an excessively large maximum size of MA constituent, and has poor resistance to cold brittleness.

Test No. 54 is a sample undergone austempering at an excessively high holding temperature (520° C.), fails to have a sufficient volume fraction of retained γ, and has poor TS-EL balance.

Test No. 55 is a sample undergone austempering for an excessively short holding time (70 seconds), has an excessively high volume fraction of MA constituent (12 percent by volume), has an excessively large maximum size of MA constituent, and is poor in resistance to cold brittleness.

Test No. 56 is a sample undergone cooling after soaking at an excessively low cooling rate (3° C./second), has an excessively high volume fraction of ferrite (39 percent by volume), thereby fails to have a satisfactory tensile strength of 1180 MPa or more, and is poor in resistance to cold brittleness.

Test No. 58 is a sample undergone cooling after soaking at an excessively high average cooling rate (60° C./second), fails to give a metal structure specified in the present invention, has poor TS-EL balance and inferior resistance to cold brittleness. Specifically, this sample has an excessively low volume fraction of ferrite, an excessively high volume fraction of MA constituent, and an excessively large maximum size of MA constituent.

Test Nos. 62 to 74 in Tables 6 and 7 are samples which were subjected to electrogalvanizing (EG), hot-dip galvanizing (GI), or galvannealing (GA), after the continuous annealing step. Test Nos. 62 to 72 are inventive examples, and Test Nos. 73 and 74 are comparative examples.

Test No. 73 is a sample undergone cooling at a cooling stop temperature (450° C.) higher than 400° C., fails to have a satisfactory tensile strength of 1180 MPa or more.

Test No. 74 is a sample undergone austempering at an excessively high holding temperature (600° C., fails to have a sufficient volume fraction of retained γ, have a low tensile strength and has poor TS-EL balance.

TABLE 6

| Test No | Steel Type | $Ac_1$ + 20 (° C.) | $Ac_3$ (° C.) | Soaking temperature (° C.) | Cooling rate (° C./s) | Cooling stop temperature (° C.) | Rate of temperature rise (° C./s) | Austempering temperature (° C.) | Austempering time (s) | Plating |
|---|---|---|---|---|---|---|---|---|---|---|
| 62 | A | 773 | 863 | 830 | 15 | 200 | 1 | 400 | 700 | EG |
| 63 | A | 773 | 863 | 840 | 20 | 200 | 1 | 380 | 700 | EG |
| 64 | A | 773 | 863 | 820 | 10 | 180 | 1 | 420 | 100 | GI |
| 65 | A | 773 | 863 | 810 | 20 | 200 | 1 | 450 | 100 | GA |
| 66 | A | 773 | 863 | 800 | 10 | 200 | 1 | 440 | 100 | GA |
| 67 | A | 773 | 863 | 850 | 5 | 220 | 1 | 400 | 500 | EG |
| 68 | A | 773 | 863 | 860 | 5 | 200 | 1 | 400 | 500 | EG |
| 69 | B | 773 | 863 | 790 | 50 | 180 | 1 | 400 | 100 | GI |
| 70 | B | 773 | 863 | 810 | 20 | 150 | 1 | 380 | 700 | EG |
| 71 | K | 773 | 863 | 870 | 10 | 220 | 1 | 400 | 100 | GI |
| 72 | K | 773 | 863 | 780 | 30 | 180 | 1 | 320 | 500 | EG |
| 73 | A | 773 | 863 | 830 | 15 | 450 | 0 | 450 | 900 | EG |
| 74 | A | 773 | 863 | 830 | 15 | 200 | 1 | 600 | 700 | EG |

TABLE 7

| Test No | YS (MPa) | TS (MPa) | EL (%) | TS × EL | Ferrite (%) | γ (%) | MA (%) | Maximum MA size (μm) | Absorbed energy at −40° C. (J) | Absorbed energy at room temperature (J) |
|---|---|---|---|---|---|---|---|---|---|---|
| 876 | 1183 | 18.2 | 21531 | 23 | 11 | 4 | 2 | 10 | 10 | 876 |
| 920 | 1193 | 17.2 | 20520 | 21 | 10 | 3 | 2 | 10 | 10 | 920 |
| 933 | 1202 | 14.5 | 17429 | 13 | 9 | 2 | 3 | 10 | 10 | 933 |
| 945 | 1256 | 15.6 | 19594 | 32 | 9 | 4 | 4 | 10 | 10 | 945 |
| 889 | 1233 | 14.9 | 18372 | 15 | 9 | 4 | 3 | 10 | 10 | 889 |
| 882 | 1245 | 17.3 | 21539 | 27 | 11 | 3 | 4 | 10 | 10 | 882 |
| 895 | 1199 | 16.5 | 19784 | 30 | 10 | 5 | 6 | 9 | 9 | 895 |
| 820 | 1187 | 18.4 | 21841 | 34 | 11 | 5 | 5 | 9 | 10 | 820 |
| 870 | 1210 | 15.5 | 18755 | 28 | 10 | 4 | 4 | 10 | 10 | 870 |
| 1080 | 1320 | 13.2 | 17424 | 8 | 9 | 6 | 7 | 9 | 9 | 1080 |
| 840 | 1232 | 14.1 | 17371 | 29 | 9 | 5 | 4 | 10 | 10 | 840 |
| 796 | 1168 | 15.2 | 17754 | 23 | 6 | 7 | 7 | 10 | 10 | 796 |
| 740 | 1080 | 13.6 | 14688 | 25 | 4 | 1 | 2 | 10 | 10 | 740 |
| 876 | 1183 | 18.2 | 21531 | 23 | 11 | 4 | 2 | 10 | 10 | 876 |

What is claimed is:

1. A steel sheet, comprising in percent by mass:
carbon (C) in a content of from 0.10% to 0.30%,
silicon (Si) in a content of from 1.40% to 3.0%,
manganese (Mn) in a content of from 0.5% to 3.0%,
phosphorus (P) in a content of 0.1% or less,
sulfur (S) in a content of 0.05% or less,
aluminum (Al) in a content of from 0.005% to 0.20%,
nitrogen (N) in a content of 0.01% or less, and
oxygen (O) in a content of 0.01% or less,
with the remainder including iron (Fe) and inevitable impurities;
the steel sheet having a volume fraction of ferrite of from 5% to 35% and a volume fraction of bainitic ferrite and/or tempered martensite of 60% or more based on the total volume of structures as determined through observation of the structures at a position of a depth one-quarter the thickness of the steel sheet under a scanning electron microscope;
the steel sheet having a volume fraction of a mixed structure (martensite-austenite constituent) of fresh martensite and retained austenite of 1% to 6% based on the total volume of structures as determined through observation of the structures under an optical microscope;
the steel sheet having a volume fraction of retained austenite of 5% or more based on the total volume of structures as determined through X-ray diffractometry of retained austenite; and
the steel sheet having a tensile strength of 1180 MPa or more.

2. The steel sheet according to claim 1,
further comprising, as an additional element, at least one element selected from the group consisting of:
chromium (Cr) in a content of from 1.0% or less and
molybdenum (Mo) in a content of from 1.0% or less.

3. The steel sheet according to claim 1,
further comprising, as an additional element, at least one element selected from the group consisting of:
titanium (Ti) in a content of 0.15% or less,
niobium (Nb) in a content of 0.15% or less, and
vanadium (V) in a content of 0.15% or less.

4. The steel sheet according to claim 1,
further comprising, as an additional element, at least one element selected from the group consisting of:
copper (Cu) in a content of from 1.0% or less and
nickel (Ni) in a content of from 1.0% or less.

5. The steel sheet according to claim 1,
further comprising, as an additional element, boron (B) in a content of from 0.005% or less.

6. The steel sheet according to claim 1,
further comprising, as an additional element, at least one element selected from the group consisting of:
calcium (Ca) in a content of 0.01% or less,
magnesium (Mg) in a content of 0.01% or less, and
one or more rare-earth elements (REM) in a content of 0.01% or less.

7. A method for manufacturing the steel sheet of claim 1, the method comprising:

preparing a steel sheet through rolling a steel comprising carbon (C) in a content of from 0.10% to 0.30%, silicon (Si) in a content of from 1.40% to 3.0%, manganese (Mn) in a content of from 0.5% to 3.0%, phosphorus (P) in a content of 0.1% or less, sulfur (S) in a content of 0.05% or less, aluminum (Al) in a content of from 0.005% to 0.20%, nitrogen (N) in a content of 0.01% or less, and oxygen (O) in a content of 0.01% or less, with the remainder including iron (Fe) and inevitable impurities;

soaking the rolled steel sheet at a temperature higher than $Ac_1$ point by 20° C. or more and lower than the $Ac_3$ point;

cooling the soaked steel sheet at an average cooling rate of 5° C./second or more to a temperature in the range of from 100° C. to 400° C.; and holding the cooled steel sheet in a temperature range of from 200° C. to 500° C. for 100 seconds or longer.

8. A method for manufacturing the steel sheet of claim 1, the method comprising:

preparing a steel sheet through rolling a steel comprising carbon (C) in a content of from 0.10% to 0.30%, silicon (Si) in a content of from 1.40% to 3.0%, manganese (Mn) in a content of from 0.5% to 3.0%, phosphorus (P) in a content of 0.1% or less, sulfur (S) in a content of 0.05% or less, aluminum (Al) in a content of from 0.005% to 0.20%, nitrogen (N) in a content of 0.01% or less, and oxygen (O) in a content of 0.01% or less, with the remainder including iron (Fe) and inevitable impurities;

soaking the rolled steel sheet at a temperature equal to or higher than $Ac_3$ point;

cooling the soaked steel sheet at an average cooling rate of 50° C./second or less to a temperature in the range of from 100° C. to 400° C.; and holding the cooled steel sheet in a temperature range of from 200° C. to 500° C. for 100 seconds or longer.

9. The steel sheet according to claim 1, comprising a volume fraction of ferrite of from 12% to 35%.

10. The steel sheet according to claim 1, wherein the volume fraction of the martensite-austenite constituent is from 2% to 6%.

11. The steel sheet according to claim 1, wherein the volume fraction of the martensite-austenite constituent is from 3% to 6%.

12. The steel sheet according to claim 1, wherein the volume fraction of the martensite-austenite constituent is from 1% to 5%.

13. The steel sheet according to claim 1, wherein the volume fraction of the martensite-austenite constituent is from 1% to 4%.

14. The steel sheet according to claim 1, wherein the steel sheet, after being subjected to an austempering time of at least 100 seconds has a volume fraction of ferrite of from 5% to 35% and a volume fraction of bainitic ferrite and/or tempered martensite of 60% or more based on the total volume of structures as determined through observation of the structures at a position of a depth one-quarter the thickness of the steel sheet under a scanning electron microscope;

a volume fraction of a mixed structure (martensite-austenite constituent) of fresh martensite and retained austenite of 6% or less based on the total volume of structures as determined through observation of the structures under an optical microscope;

a volume fraction of retained austenite of 5% or more based on the total volume of structures as determined through X-ray diffractometry of retained austenite; and having a tensile strength of 1180 MPa or more.

15. The steel sheet according to claim 9, comprising the volume fraction of ferrite of from 12% to 25%.

16. The steel sheet according to claim 1, wherein the volume fraction of retained austenite of 11% or more based on the total volume of structures as determined through X-ray diffractometry of retained austenite.

17. The steel sheet according to claim 1, wherein the volume fraction of retained austenite of 12% or more based on the total volume of structures as determined through X-ray diffractometry of retained austenite.

18. The steel sheet according to claim 1, wherein the balance between tensile strength and elongation (TS-EL balance) is 18,000 or more.

19. The steel sheet according to claim 1, comprising a volume fraction of tempered martensite of 65% or more based on the total volume of structures as determined through observation of the structures at a position of a depth one-quarter the thickness of the steel sheet under a scanning electron microscope.

20. The steel sheet according to claim 1, wherein the volume fraction of retained austenite is 7% or more.

* * * * *